US010071884B2

(12) United States Patent
Li et al.

(10) Patent No.: US 10,071,884 B2
(45) Date of Patent: Sep. 11, 2018

(54) DETECTION OF STATE OF ENGAGEMENT BETWEEN STEP AND COMB PLATE OF PASSENGER CONVEYOR

(71) Applicant: Otis Elevator Company, Farmington, CT (US)

(72) Inventors: JianGuo Li, Hangzhou (CN); Nigel Morris, West Hartford, CT (US); Alois Senger, Gresten (AT); Jianwei Zhao, Shanghai (CN); ZhaoXia Hu, Hangzhou (CN); Qiang Li, Shanghai (CN); Hui Fang, Shanghai (CN); Zhen Jia, Shanghai (CN); Anna Su, Shanghai (CN); Alan Matthew Finn, Hebron, CT (US); LongWen Wang, Shanghai (CN); Qian Li, Hangzhou (CN); Gero Gschwendtner, Pressbaum (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/663,435

(22) Filed: Jul. 28, 2017

(65) Prior Publication Data

US 2018/0029841 A1 Feb. 1, 2018

(30) Foreign Application Priority Data

Jul. 29, 2016 (CN) ..... 2016 1 0610012

(51) Int. Cl.

*B66B 29/06* (2006.01)
*B66B 25/00* (2006.01)
*B66B 21/02* (2006.01)

(52) U.S. Cl.

CPC ..... *B66B 29/06* (2013.01); *B66B 21/02* (2013.01); *B66B 25/003* (2013.01); *B66B 25/006* (2013.01)

(58) Field of Classification Search

CPC ..... B66B 29/06; B66B 25/006; B66B 25/003; B66B 21/02

See application file for complete search history.

(56) References Cited

U.S. PATENT DOCUMENTS 4,800,998 A 1/1989 Myrick
5,718,319 A 2/1998 Gih
(Continued)

FOREIGN PATENT DOCUMENTS

CN 102234058 A 11/2011
CN 203820269 U 9/2014
(Continued)

OTHER PUBLICATIONS

Kone, [online]; [retrieved on Jul. 26, 2017]; retrieved from the Internet http://cdn.kone.com/www.kone.co.id/en/Images/brochure-escalators-and-autowalks-safety-factsheet.pdf?v=1Kone, "Kone Safety Features for Escalators and Autowalks," Kone, 2017, pp. 1-2.
(Continued)

*Primary Examiner* — Gene O Crawford
*Assistant Examiner* — Lester Rushin, III
(74) *Attorney, Agent, or Firm* — Cantor Colburn LLP

(57) ABSTRACT

The present invention relates to the field of passenger conveyor technologies, and provides an engaging state detection system of a passenger conveyor and a detection method thereof. In the engaging state detection system and detection method of the present invention, a depth sensing sensor is used to sense at least an engaging portion between a step and a comb plate of the passenger conveyor to obtain depth maps, and the depth maps are analyzed by a processing apparatus to detect whether an engaging state between the step and the comb plate is a normal state. The detection of the engaging state includes detection on whether comb teeth of the comb plate are broken, whether engaging teeth
(Continued)

of the step are broken, and/or whether a foreign matter exists on an engaging line.

27 Claims, 5 Drawing Sheets

(56) References Cited

U.S. PATENT DOCUMENTS

| | | | |
|---|---|---|---|
| 6,241,070 | B1 | 6/2001 | Loder |
| 6,644,457 | B2 | 11/2003 | Lauch |
| 6,976,571 | B2 | 12/2005 | Schops et al. |
| 7,002,462 | B2 | 2/2006 | Welch |
| 7,334,672 | B2 | 2/2008 | Sheehan et al. |
| 8,264,538 | B2 | 9/2012 | Horbruegger et al. |
| 2011/0011700 | A1 | 1/2011 | Plathin et al. |
| 2015/0203330 | A1 | 7/2015 | Ischganeit et al. |

FOREIGN PATENT DOCUMENTS

| | | | |
|---|---|---|---|
| DE | 29907184 | U1 | 8/1999 |
| DE | 10219483 | A1 | 11/2003 |
| DE | 10223393 | A1 | 12/2003 |
| DE | 102012109390 | A1 | 4/2014 |
| EP | 0801021 | A2 | 10/1997 |
| EP | 1013599 | A1 | 6/2000 |
| EP | 1309510 | B1 | 10/2009 |
| FR | 2773791 | A1 | 7/1999 |
| JP | H06144766 | A | 5/1994 |
| JP | H0725575 | A | 1/1995 |
| JP | 2006027790 | A | 2/2006 |
| JP | 2014080267 | A | 5/2014 |
| WO | 2007031106 | A1 | 3/2007 |
| WO | 2014208906 | A1 | 12/2014 |
| WO | 2015090764 | A1 | 6/2015 |
| WO | 2015171774 | A1 | 11/2015 |

OTHER PUBLICATIONS

Extended European Search Report issued in European Patent Application No. 17184137.2 dated Mar. 21, 2018, 11 pages.

DETECTION OF STATE OF ENGAGEMENT BETWEEN STEP AND COMB PLATE OF PASSENGER CONVEYOR

FOREIGN PRIORITY

This application claims priority to Chinese Patent Application No. 201610610012.5, filed Jul. 29, 2016, and all the benefits accruing therefrom under 35 U.S.C. § 119, the contents of which in its entirety are herein incorporated by reference.

TECHNICAL FIELD

The present invention belongs to the field of Passenger Conveyor technologies, and relates to automatic detection of an engaging state between Steps and Comb Plates of a passenger conveyor.

BACKGROUND ART

A passenger conveyor (such as an escalator or a moving walk) is increasingly widely used in public places such as subways, shopping malls, and airports, and operation safety thereof is increasingly important.

The passenger conveyor has moving steps and fixed comb plates. The comb plates are fixed at an entry and an exit of the passenger conveyor. During operation, engaging teeth of the steps and Comb teeth of the comb plates are well engaged to each other, such that the steps can smoothly enter a return track and an external foreign matter is prevented from being taken into the passenger conveyor. Therefore, an engaging state between the engaging teeth of the steps and the comb teeth of the comb plates is very important for safe operation of the passenger conveyor. For example, when the engaging teeth of the steps are broken or the comb teeth of the comb plates are broken, cases such as an object carried by a passenger being entrapped into the passenger conveyor may easily occur, and the risk when a passenger takes the passenger conveyor greatly increases. For another example, when an external foreign matter such as a coin is entrapped, it easily causes misplacement of engagement, which will easily damage the steps and the comb plates, and bring in danger to the passenger.

Therefore, it becomes very important to discover an abnormal engaging state between the engaging teeth of the steps and the comb teeth of the comb plates in time.

SUMMARY OF THE INVENTION

According to an aspect of the present invention, an engaging state detection system of steps and comb plates of a passenger conveyor is provided, including: a depth sensing sensor configured to sense at least an engaging portion between a step and a comb plate of the passenger conveyor to obtain depth maps; and a processing apparatus configured to analyze the depth maps to detect whether the engaging state between the step and the comb plate is a normal state, the processing apparatus being configured to include: a background acquisition module configured to acquire a background model based on depth maps sensed when the passenger conveyor has no load and the engaging state is a normal state; a foreground detection module configured to compare a depth map sensed in real time with the background model to obtain a foreground object; and an engaging state judgment module configured to process data at least based on the foreground object to judge whether the engaging state is a normal state.

According to another aspect of the present invention, an engaging state detection method of steps and comb plates of a passenger conveyor is provided, including steps of: sensing, by a depth sensing sensor, at least an engaging portion between a step and a comb plate of the passenger conveyor to obtain depth maps; acquiring a background model based on depth maps sensed when the passenger conveyor has no load and the engaging state is a normal state; comparing a depth map sensed in real time with the background model to obtain a foreground object; and processing data at least based on the foreground object to judge whether the engaging state is a normal state.

According to still another aspect of the present invention, a passenger conveying system is provided, including a passenger conveyor and the engaging state detection system described above.

The foregoing features and operations of the present invention will become more apparent according to the following descriptions and accompanying drawings.

BRIEF DESCRIPTION OF THE DRAWINGS

The above and other advantages of the present invention will be more complete and clearer through the following detailed descriptions with reference to the accompanying drawings, where identical or similar elements are presented by using the same reference numerals.

DETAILED DESCRIPTION

Figure 1:
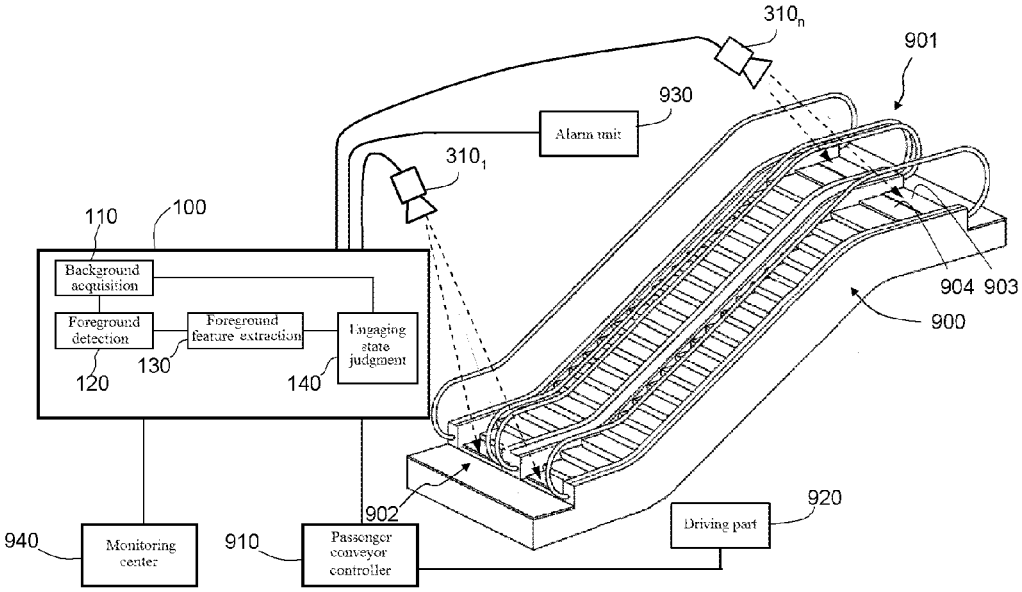
FIG. 1 is a schematic structural diagram of an engaging state detection system of steps and comb plates of a passenger conveyor according to a first embodiment of the present invention.

The present invention is now described more completely with reference to the accompanying drawings. Exemplary embodiments of the present invention are illustrated in the accompanying drawings. However, the present invention may be implemented in lots of different forms, and should not be understood as being limited to the embodiments described herein. On the contrary, the embodiments are provided to make the disclosure be thorough and complete, and fully convey the concept of the present invention to those skilled in the art. In the accompanying drawings, identical reference numerals refer to identical elements or members, and therefore, descriptions of them will be omitted.

Some block diagrams shown in the accompanying drawings are functional entities, and do not necessarily correspond to physically or logically independent entities. The functional entities may be implemented in the form of software, or the functional entities are implemented in one or more hardware modules or an integrated circuit, or the functional entities are implemented in different processing apparatuses and/or microcontroller apparatuses.

In the present invention, a passenger conveyor includes an Escalator and a Moving Walker. In the following illustrated embodiments, an engaging state detection state and a detection method according to the embodiments of the present invention are illustrated in detail by taking an escalator as an example. However, it should be appreciated that the engaging state detection system and detection method for an escalator in the following embodiments may also be analogically applied to a moving walker. Adaptive improvements or the like that may need to be performed can be obtained by those skilled in the art with the teachings of the embodiments of the present invention.

It should be noted that, in the present invention, the engaging state between the steps and the comb plates of the passenger conveyor being in a "normal state" refers to a working condition that at least does not bring a potential safety hazard to passengers. In contrast, an "abnormal state" refers to a working condition that at least may bring a potential safety hazard to passengers, for example, at least one of cases such as broken engaging teeth of a step, broken (e.g., cracked) comb teeth of a comb plate, and a foreign matter being clamped in an engaging line between a step and a comb plate, or other working conditions that do not in line with related standards or specifications related to the engaging state. Therefore, in the following embodiments, detections on broken comb teeth of the comb plate, broken engaging teeth of the step, and a foreign matter on an engaging line between the comb plate and the step all belong to the range of detection on the engaging state between the step and the comb plate.

Figure 2:
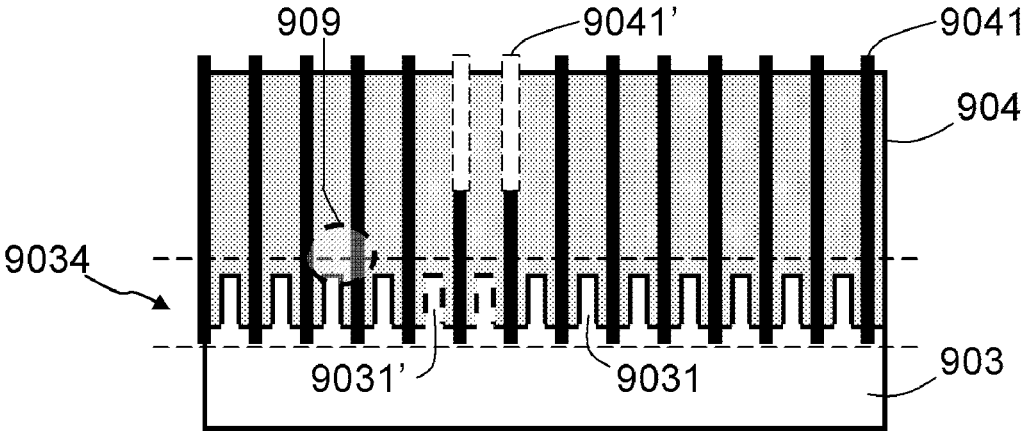
FIG. 2 is a schematic diagram of engagement between engaging teeth of a detected step and comb teeth of a comb plate.

FIG. 1 is a schematic structural diagram of an engaging state detection system of steps and comb plates of a passenger conveyor according to a first embodiment of the present invention, and FIG. 2 is a schematic diagram of engagement between engaging teeth of a detected step and comb teeth of a comb plate. The engaging state detection system with reference to the embodiments shown in FIG. 1 and FIG. 2 may be used for detecting whether comb teeth 9031 of comb plates 903 of an escalator 900 of the passenger conveyor in a daily operation condition (including an operation condition having a passenger and a no-load operation condition having no passengers) are broken.

Referring to FIG. 1 and FIG. 2, the comb plates 903 are generally fixed in an entry/exit region 901 at a first end and an entry/exit region 902 at a second end of the escalator 900. In a normal state, the comb teeth 9031 of the comb plates 903 are not broken, engaging teeth 9041 of the steps 904 are not broken, and there is no foreign matter clamped in engaging lines 9034 between the comb plates 903 and the steps 904. Therefore, the comb teeth 9031 of the comb plates 903 are smoothly engaged with the engaging teeth 9041 of the steps 904, the engaging state is good, and it is highly safe. In a specific engaging state, each comb tooth 9031 is arranged in a slot between two comb teeth 9031, such that a foreign matter on the step 904 can be smoothly removed.

However, if a comb tooth 9031 of a comb plate 903 is broken, for example, a cracked comb tooth 9031' shown in FIG. 2, a foreign matter (such as clothes of a passenger) on the step 904 is easily entrapped into the escalator 900 from the engaging line 9034 corresponding to the comb tooth 9031', causing a severe accident. Therefore, the engaging state detection system according to the embodiment of the present invention constantly or periodically detects the comb teeth 9031 of the comb plates 903, to detect the breakage of the comb tooth 9031 in time.

The engaging state detection system in the embodiment shown in FIG. 1 includes a sensing apparatus 310 and a processing apparatus 100 coupled to the sensing apparatus 310. The escalator 900 includes a passenger conveyor controller 910, a driving part 920 such as a motor, an alarm unit 930, and the like.

The sensing apparatus 310 is specifically a Depth Sensing Sensor. In another alternative embodiment, the sensing apparatus 310 may be a 2D imaging sensor or a combination of a 2D imaging sensor and a depth sensing sensor. According to a specific requirement and a monitoring range of the sensor, the escalator 900 may be provided with one or more sensing apparatuses 310, that is, multiple depth sensing sensors, for example, $\mathbf{310}_1$ to $\mathbf{310}_n$, where N is an integer greater than or equal to 1. The sensing apparatuses 310 are mounted in such a manner that they can relatively clearly and accurately acquire the engaging state of the escalator 900, and their specific mounting manners and mounting positions are not limited. In this embodiment, there are two (n=2) sensing apparatuses 310, which are respectively disposed approximately above the comb plates 903 in the entry/exit regions (901 and 902) at two ends of the escalator 900 correspondingly, in order to separately sense the comb plates 903 of the entry/exit regions 901 and 902 and the steps 904 engaged with the comb plates 903.

Specifically, the depth sensing sensor may be any 1D, 2D or 3D depth sensor or a combination thereof. A depth sensing sensors of a corresponding type may be selected according to specific application environments to sense the comb plates 903 accurately. Such a sensor is operable in an optical, electromagnetic or acoustic spectrum capable of producing a depth map (also known as a point cloud or occupancy grid) with corresponding texture. Various depth sensing sensor technologies and devices include, but are not limited to, structured light measurement, phase shift measurement, time-of-flight measurement, a stereo triangulation device, an optical triangulation device plate, a light field camera, a coded aperture camera, a computational imaging technology, simultaneous localization and map-building (SLAM), an imaging radar, an imaging sonar, an echolocation device, a scanning LIDAR, a flash LIDAR, a passive infrared (PIR) sensor, and a small focal plane array (FPA), or a combination including at least one of the foregoing. Different technologies may include active (transmitting and receiving a signal) or passive (only receiving a signal) and are operable in a band of electromagnetic or acoustic spectrum (such as visual and infrared). Depth sensing may achieve particular advantages over conventional 2D imaging. Infrared sensing may achieve particular benefits over visible spectrum imaging. Alternatively or additionally, the sensor may be an infrared sensor with one or more pixel spatial resolutions, e.g., a passive infrared (PIR) sensor or a small IR focal plane array (FPA).

It should be noted that there may be qualitative and quantitative differences between a 2D imaging sensor (e.g., a conventional security camera) and the 1D, 2D, or 3D depth sensing sensor in terms of the extent that the depth sensing provides numerous advantages. In 2D imaging, reflected color (a mixture of wavelengths) from the first object in each radial direction of the imager is captured. A 2D image, then, may include a combined spectrum of source lighting and a spectral reflectivity of an object in a scene. The 2D image may be interpreted by a person as a picture. In the 1D, 2D, or 3D depth-sensing sensor, there is no color (spectral) information; more specifically, a distance (depth, range) to a first reflection object in a radial direction (1D) or directions (2D, 3D) from the sensor is captured. The 1D, 2D, and 3D technologies may have inherent maximum detectable range limits and may have a spatial resolution relatively lower than that of a typical 2D imager. In terms of relative immunity to ambient lighting problems, compared with the conventional 2D imaging, the 1D, 2D, or 3D depth sensing may advantageously provide improved operations, and better separation and better privacy protection of occluding objects. Infrared sensing may achieve particular benefits over visible spectrum imaging. For example, it is possible that a 2D image cannot be converted into a depth map and a depth map may not be able to be converted into a 2D image (for example, artificial assignment of continuous colors or brightness to continuous depths may cause a person to roughly interpret a depth map in a manner somewhat akin to how a person sees a 2D image, while the depth map is not an image in a conventional sense).

Figure 3:
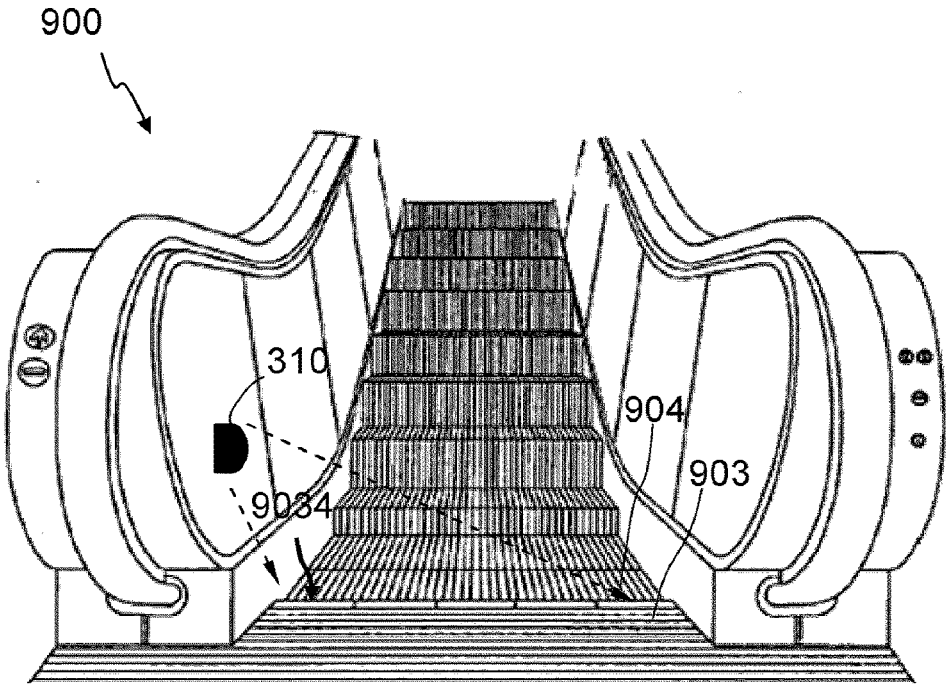
FIG. 3 is a schematic diagram of mounting of a sensing apparatus of a passenger conveyor according to an embodiment of the present invention.

The specific mounting manner of the depth sensing sensor is not limited to the manner shown in FIG. 1. In another alternative embodiment, as shown in FIG. 3, the sensing apparatus 310 of the depth sensing sensor may be mounted near the engaging line 9034 between the comb plate 903 and the step 904, for example, mounted on a handrail side plate of the escalator 900 facing the position of the engaging line 9034. In this way, the depth maps acquired by the depth sensing sensor are accurate, and the accuracy of a detection result is correspondingly improved.

As shown in FIG. 1 continuously, the sensing apparatus 310 of the depth sensing sensor senses the comb plates 903 of the escalator 900 and obtains multiple depth maps in real time, wherein each pixel or occupancy grid of the depth map also has corresponding depth texture (reflecting depth information).

If the comb plates 903 need to be monitored all the time, the multiple sensing apparatuses $\mathbf{310}_1$ to $\mathbf{310}_n$ all need to work at the same time to acquire corresponding depth maps regardless of an operation condition having a passenger or a no-load operation condition having no passengers. If the comb plates 903 need to be detected in a predetermined time, the multiple sensing apparatuses $\mathbf{310}_1$ to $\mathbf{310}_n$ all need to work at the same time to acquire corresponding depth maps when the escalator 900 stops operation or the escalator 900 operates normally in a no-load state. In the depth maps acquired in this case, there is no passenger or article carried by the passenger correspondingly located on the comb teeth 9031, the subsequent analysis processing will be more accurate, and thus broken comb teeth can be detected more accurately. The multiple sensing apparatuses $\mathbf{310}_1$ to $\mathbf{310}_n$ all need to work at the same time to acquire corresponding depth maps, and each depth map is transmitted to the processing apparatus 100 and then stored. The above process of the sensing apparatus 310 sensing and acquiring the depth maps may be controlled and implemented by the processing apparatus 100 or the passenger conveyor controller 910. The processing apparatus 100 is further responsible for processing data of each depth map, and finally obtaining information indicating whether the comb teeth 9031 of the escalator 900 are in a normal state, for example, determining whether there is a broken comb tooth 9031.

As shown in FIG. 1 continuously, the processing apparatus 100 is configured to include a background acquisition module 110 and a foreground detection module 120. In the background acquisition module 110, a background model at least related to the comb teeth 9031 is acquired by learning 3D depth maps when the escalator 900 is in a no-load (that is, no passenger exists) working condition and the comb teeth 9031 are in a normal state (that is, there is no broken comb teeth 9031). The background model may be established in an initialization stage of the engaging state detection system, that is, before the comb teeth 9031 in a daily operation condition are detected, the engaging state detection system is initialized to obtain the background model. The background model may be established through leaning by using, but not limited to, a Gaussian Mixture Model, a Code Book Model, Robust Principle Components Analysis (RPCA), or the like. The background model obtained by learning the depth maps acquired by the depth sensing sensor is a typical depth background model.

It should be appreciated that the background model may be updated adaptively in the subsequent detection stage of the comb teeth 9031. When the application scene, sensor type, or setting is changed, a corresponding background model may be acquired through learning once again in the initialization stage.

The foreground detection model 120 is configured to compare a real-time acquired depth map with the background model to obtain a foreground object. Specifically, during the comparison, if the depth sensing sensor is used, the data frame acquired in real time is a depth map, and the background model is also formed based on the 3D depth maps. For example, an occupation grid of the depth map may be compared with a corresponding occupation grid of the background model (e.g., a depth difference is calculated), depth information of the occupation grid is retained when the difference is greater than a predetermined value (indicating that the occupation grid is), and thus a foreground object can be obtained. The above comparison processing includes differencing processing of depth values, and therefore, it may also be specifically understood as differential processing or a differential method. The foreground object is a passenger, an article carried by the passenger, and the like in most cases. Definitely, if a comb plate 903 is broken, when a corresponding depth map portion is compared with a corresponding portion of the background model, the obtained foreground object may also include a feature reflecting that the comb plate 903 is broken (if any). In an embodiment, the foreground detection module 120 may apply some filtering technologies to remove noise of the foreground object, for example, the noise is removed by using erosion and dilation image processing technologies, to obtain the foreground object more accurately. It should be noted that, the filtering may include convolution related to a space, time, or time-space kernel, or the like.

In an embodiment, the processing apparatus 100 further includes a foreground feature extraction module 130. The foreground feature extraction module 130 extracts a corresponding foreground feature from the foreground object. To detect the comb plate 903 of the escalator 900, the extracted foreground feature includes a shape and texture of the foreground object, and even includes information such as a position, wherein the shape information may be embodied or obtained by extracted edge information. By using depth maps acquired by the depth sensing sensor as an example, the shape, texture, and position information are embodied by changes in depth values of occupation grids in the foreground object.

Referring to FIG. 1 continuously, further, the processing apparatus 100 further includes an engaging state judgment module 140. The engaging state judgment module 140 judges whether the comb plate 903 is in a normal state based on the foreground feature. Specifically, the foreground feature may be compared and judged in the background model, for example, the shape feature, the texture feature, and the position feature of the foreground object are compared with the shape feature, the texture feature, and the position feature related to the comb plate 903 in the background model, to judge whether the comb plate 903 is broken. It should be noted that, the feature information related to the shape, texture, and position of the comb plate 903 in the background model may be obtained in the background acquisition model 110.

In an embodiment, if the foreground feature is a foreground feature related to the foreground object of a passenger, by comparing the foreground feature with feature information related to the comb plate 903 in the background model, it can be judged that the foreground feature is not related to the comb plate 903. Moreover, whether the foreground object is located on the comb plate 903 may be judged according to the position feature information thereof. If the judgment result is "yes", the judgment on whether the comb teeth 9031 are broken based on the currently processed depth map is given up or the judgment result of whether the engaging state corresponding to the currently processed depth map is a normal state is given up. This is because the comb teeth 9031 of the comb plate 903 are inevitably blocked partially in this case, and therefore, it is difficult to judge whether the comb teeth 9031 in the blocked portion are broken. Data of a next depth map is processed, till it is judged from the acquired position feature of the foreground object that the passenger or the article carried by the passenger is not located on the comb plate 903, and the judgment result of the depth map is used as a detection result of the comb plate 903. Definitely, it should be appreciated that if the foreground feature is a foreground feature related to the foreground object such as a passenger, the judgment processing based on the current depth map may not be given up, thereby implementing judgment on whether the comb teeth 9031 in a non-blocked portion are broken.

By using that the comb teeth 9031 are broken in the data processing of the depth map as an example, the acquired foreground object may include a depth map of at least some of the comb teeth 9031 of the comb plate 903, and features of the object such as the position, texture, and 3D shape are also extracted based on the depth map of the object, and are further compared with the background model. For example, by comparing features such as the texture and the 3D shape corresponding to the same position, it can be judged that a comb tooth 9031 is absent at a position in this part of the comb plate 903, thereby directly judging that the comb tooth 9031 is broken.

It should be noted that, herein, the shape feature (descriptor) may be calculated through a technology such as histogram of oriented gradients (HoG), Zernike moment, Centroid Invariance to boundary point distribution, or Contour Curvature. Other features may be extracted to provide additional information for shape (or morphological) matching or filtering. For example, the other features may include, but are not limited to, Scale Invariant Feature Transform (SIFT), a Speed-Up Robust Feature (SURF) algorithm, Affine Scale Invariant Feature Transform (ASIFT), other SIFT variables, Harris Corner Detector, a Smallest Univalue Segment Assimilating Nucleus (SUSAN) algorithm, Features from Accelerated Segment Test (FAST) corner detection, Phase Correlation, Normalized Cross-Correlation, a Gradient Location Orientation Histogram (GLOH) algorithm, a Binary Robust Independent Elementary Features (BRIEF) algorithm, a Center Surround Extremas (CenSure/STAR) algorithm, an Oriented and Rotated BRIEF (ORB) algorithm, and other features.

In still another alternative embodiment, in a detection situation, the depth map acquired by the sensing apparatus 310 is actually basically identical to the depth map data for calculating the background model (for example, when the detected escalator 900 has no load and the comb teeth 9031 are not broken). In this case, there is basically no foreground object (for example, only noise information exists) in the foreground detection module 120. In this case, the engaging state judgment module 140 may directly determine that the engaging state of the comb teeth 9031 is a normal state, that is, no comb teeth 9031 are broken. Therefore, it is unnecessary to make a judgment based on the foreground feature extracted by the foreground feature extraction module 130. Definitely, the above situation may also be understood as follows: there is basically no foreground object obtained in the foreground detection module 120, the foreground feature extraction module 130 cannot extract the feature related to the comb teeth 9031, and the engaging state judgment module 140 still obtains, based on feature comparison, the judgment result that the engaging state of the comb teeth 9031 is the normal state.

Further, the engaging state judgment module 140 may be configured to determine, when a judgment result based on multiple (for example, at least two) consecutive depth maps is that the comb plate 903 is in a same abnormal state (for example, a comb tooth 9031 is broken), that the comb teeth 9031 of the comb plate 903 are broken and the engaging state is the abnormal state. In this way, it is advantageous in improving the accuracy of judgment. It should be noted that, the consecutive depth maps may be any two depth maps in the current sequence, and are not unnecessarily two directly consecutive depth maps.

In this embodiment or other embodiments, the shape feature may be compared or classified as a particular shape, wherein one or more of the following technologies are used: clustering, Deep Learning, Convolutional Neural Networks, Recursive Neural Networks, Dictionary Learning, a Bag of visual words, a Support Vector Machine (SVM), Decision Trees, Fuzzy Logic, and so on.

When the engaging state judgment module 140 in the processing apparatus 100 according to the above embodiment determines that the detected comb plate 903 is in an abnormal state (for example, the comb plate 903 is broken), a corresponding signal may be sent to the passenger conveyor controller 910 of the escalator 900, to take a corresponding measure. For example, the controller 910 further sends a signal to the driving part 920 to reduce the running speed of the steps. The processing apparatus 200 may further send a signal to the alarm unit 930 mounted above the escalator 900, to remind the passenger to watch out. For example, a message such as "The comb plate 903 is broken. Please be careful when you pass through the entry/exit region" is broadcast. Definitely, the processing apparatus 200 may further send a signal to a monitoring center 940 of a building, or the like, to prompt that on-site processing needs to be performed in time. Measures taken specifically when it is found that the comb teeth 9031 of the comb plates 903 of the escalator 900 are broken are not limited.

The engaging state detection system of the embodiment shown in FIG. 1 above may implement real-time automatic detection on the comb teeth 9031 of the comb plates 903 of the escalator 900. The detection based on the depth maps is more accurate, and the breakage of the comb teeth 9031 of the comb plates 903 can be detected in time, thus helping prevent occurrence of accidents in time.

Figure 4:
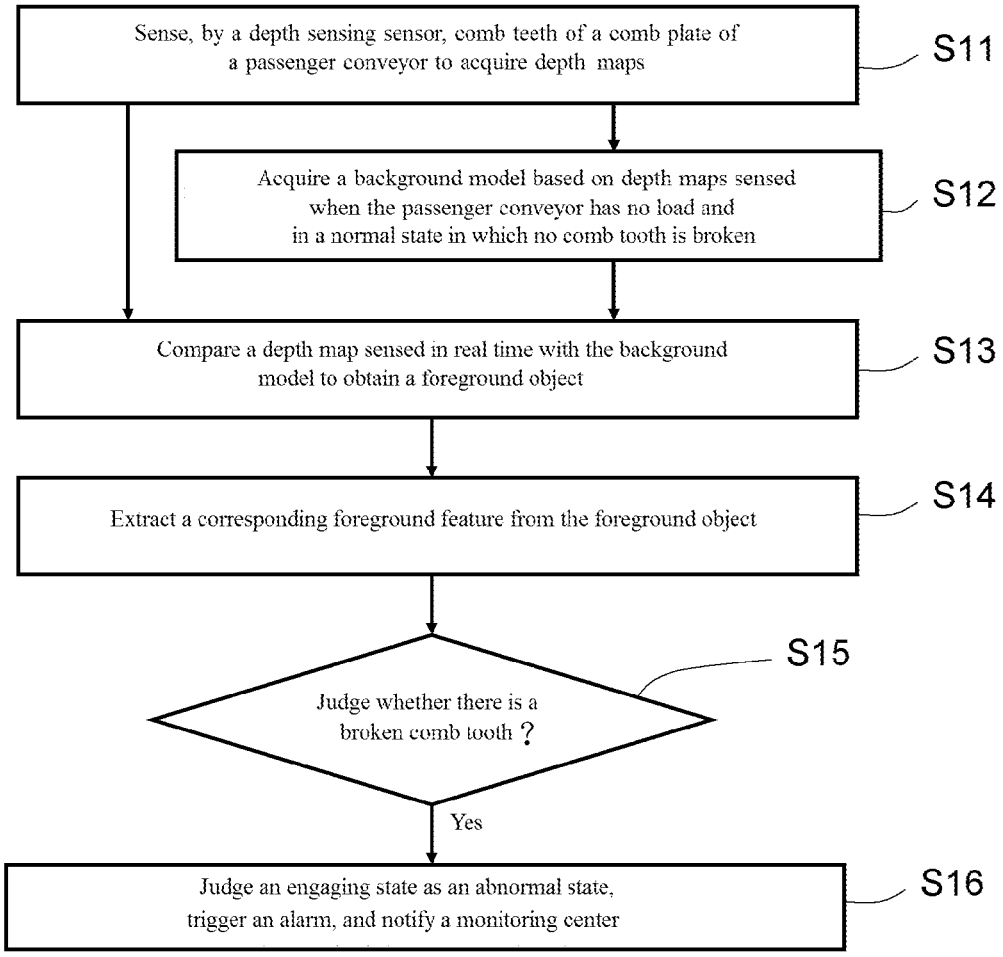
FIG. 4 is a schematic flowchart of an engaging state detection method of steps and comb plates of a passenger conveyor according to the first embodiment of the present invention.

In the following, FIG. 4 exemplifies a process of the method of detecting whether the comb teeth 9031 of the comb plate 903 are broken by the engaging state detection system in the embodiment shown in FIG. 1. The working principles of the engaging state detection system of the embodiment of the present invention are further illustrated with reference to FIG. 1 and FIG. 4.

First, in step S11, the comb teeth 9031 of the comb plate 903 of the passenger conveyor are sensed by the depth sensing sensor to acquire depth maps. During acquisition of a background model through learning, the depth maps are acquired through sensing in a no-load state and when the engaging state is a normal state (there is no passenger on the escalator 900 and the comb teeth 9031 of the comb plate 903 are not broken). In other situations, the depth maps are acquired anytime in a daily operation condition, for example, 30 depth maps may be acquired per second, and depth maps within a time period less than or equal to 1 second are acquired at intervals of a predetermined period of time, for use in the subsequent real-time analysis processing.

Further, in step S12, a background model is acquired based on the depth maps sensed when the passenger conveyor has no load and is in a normal state in which no comb tooth is broken. This step is accomplished in the background acquisition module 110, which may be implemented in an initialization stage of the system.

Specifically, when the background model is acquired through learning, feature information such as the shape, position, texture and/or edge may be extracted from multiple depth maps. Grids or regions having features that are basically not changed relatively in the multiple depth maps are accumulated, and grids or regions (of the depth maps) having features that are obviously changed are given up, and therefore, an accurate background model can be obtained through learning. For example, an algorithm adopted by the above accumulation may include, but not limited to, any one or more of the following methods: Principal Component Analysis (PCA), Robust Principal Component Analysis (RPCA), weighted averaging method of non-movement detection, Gaussian Mixture Model (GMM), Code Book Model, and the like.

Further, in step S13, a depth map sensed in real time is compared with the background model to obtain a foreground object. This step is accomplished in the foreground detection module 120. Moreover, the foreground object may be sent to the engaging state judgment module 140 to be analyzed. When the above comparison processing is differential processing, it should be noted that, when the differential processing of the current depth maps and the background model includes calculating a difference or distance between a feature of the current depth map and the feature of the background model (for example, a centroid of a cluster feature, a separated hyperplane, and the like), wherein the distance may be calculated by using a method such as Minkowski-p distance measurement, and an Uncentered Pearson Correlation method.

Further, in step S14, a corresponding foreground feature is extracted from the foreground object. This step is accomplished in the foreground feature extraction module 130, and the extracted foreground feature includes, but is not limited to, the shape and texture of the foreground object, and even further includes information such as position. By using the depth maps acquired by the depth sensing sensor as an example, the shape, texture, and position information are embodied by changes in depth values of occupation grids in the foreground object.

Further, in step S15, it is judged whether there is a broken comb tooth. If the judgment result is "yes", it indicates that the engaging state between the current comb plate 903 and step 904 is an abnormal state, and the process proceeds to step S16: when the engaging state is judged as the abnormal state, an alarm is triggered and the monitoring center 940 is notified. Step S15 and step S16 are accomplished in the engaging state judgment module 140. Specifically, in step S15, by comparing the shape feature, the texture feature, and the position feature of the foreground object with the shape feature, the texture feature, and the position feature related to the comb plate 903 in the background model, it is judged whether the comb teeth 9031 of the comb plate 903 are broken. It should be noted that, the feature information related to the shape, texture, and position of the comb plate 903 in the background model is obtained in step S12.

In an embodiment, if the foreground feature is a foreground feature related to a foreground object of a passenger, by comparing the foreground feature with feature information related to the comb plate 903 in the background model, it can be judged that the foreground feature is not related to the comb plate 903. Moreover, whether the foreground object is located on the comb plate 903 may be judged according to the position feature information thereof. If the judgment result is "yes", the judgment on whether the comb teeth 9031 are broken based on the currently processed depth map is given up or the judgment result of whether the engaging state corresponding to the currently processed depth map is a normal state is given up. This is because the comb teeth 9031 of the comb plate 903 are inevitably blocked partially in this case, and therefore, it is difficult to judge whether the comb teeth 9031 in the blocked portion are broken. In this case, data in a next depth map is processed, till it is judged from the acquired position feature of the foreground object that the passenger or the article carried by the passenger is not located on the comb plate 903, and the judgment result of the depth map is used as a detection result of the comb plate 903. Definitely, it should be appreciated that if the foreground feature is a foreground feature related to the foreground object such as a passenger, the judgment processing based on the current depth map may not be given up, thereby implementing judgment on whether the comb teeth 9031 in the non-blocked portion are broken.

By using that the comb teeth 9031 are broken in the data processing of the depth map as an example, the acquired foreground object may include a depth map of at least some of the comb teeth 9031 of the comb plate 903, and features of the object such as the position, texture, and 3D shape are also extracted based on the depth map of the object, and are further compared with the background model. For example, by comparing features such as the texture and the 3D shape corresponding to the same position, it can be judged that a comb tooth 9031 is absent at a position in this part of the comb plate 903, thereby directly judging that the comb tooth 9031 is broken.

In still another alternative embodiment, in a detection situation, the depth maps acquired in step S11 are actually basically identical to the depth map data for calculating the background model (for example, when the detected escalator 900 has no load and the comb teeth 9031 are not broken). In this case, there is basically no foreground object (for example, only noise information exists) in step S13. In this case, in step S15, it may be directly determined that the engaging state of the comb teeth 9031 is a normal state, that is, no comb teeth 9031 are broken. Therefore, it is unnecessary to perform step S14 to make a judgment on the extracted foreground feature. Definitely, the above situation may also be understood as follows: there is basically no foreground object obtained in step S13, no feature related to the comb teeth 9031 can be extracted in step S14, and in step S15, the judgment result that the engaging state of the comb teeth 9031 is the normal state is still obtained based on feature comparison.

In step S15, the process proceeds to step S16 only when the judgment result based on the multiple consecutive depth maps is "yes", and in this way, it helps improve the accuracy of judgment and prevent misoperation.

So far, the process of detecting the comb plates 903 of the above embodiment basically ends, and the process may be repeated and continuously performed, to continuously monitor the engaging state of the comb plates 903 of the escalator 900.

Figure 5:
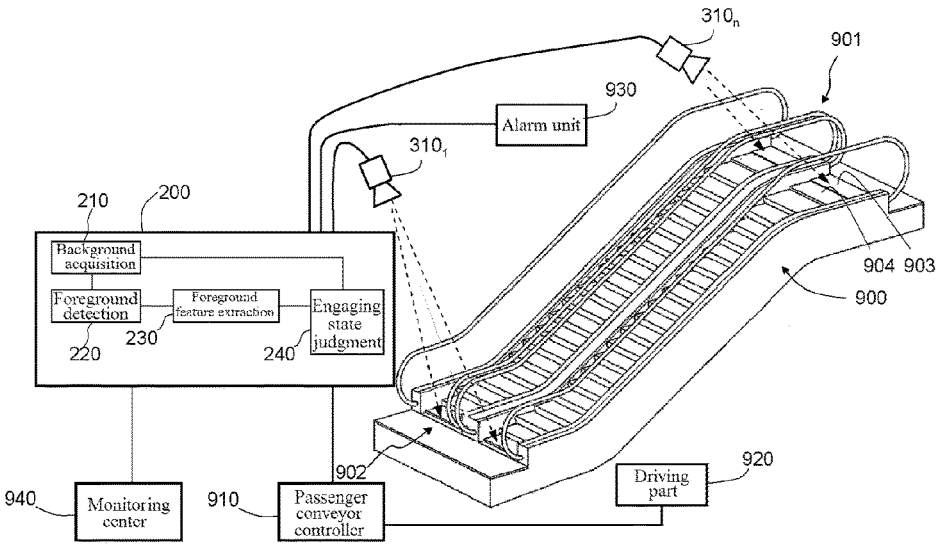
FIG. 5 is a schematic structural diagram of an engaging state detection system of steps and comb plates of a passenger conveyor according to a second embodiment of the present invention.

FIG. 5 shows a schematic structural diagram of an engaging state detection system of steps and comb plates of a passenger conveyor according to a second embodiment of the present invention. The engaging state detection system with reference to the embodiments shown in FIG. 5 and FIG. 2 may be used for detecting whether engaging teeth 9041 of steps 904 of an escalator 900 of the passenger conveyor in a daily operation condition (including an operation condition having a passenger and a no-load operation condition having no passengers) are broken.

Referring to FIG. 5 and FIG. 2, during movement, each step 904 is generally engaged with a fixed comb plate 903 at an entry/exit region 901 at a first end and an entry/exit region 902 at a second end of the escalator 900. In a normal state, the engaging teeth 9041 of the steps 904 are not broken, comb teeth 9031 of the comb plates 903 are not broken, and there is no foreign matter clamped in engaging lines 9034 between the steps 904 and the comb plates 903. Therefore, the engaging teeth 9041 of the steps 904 are smoothly engaged with the comb teeth 9031 of the comb plates 903, the engaging state is good, and it is highly safe.

However, if an engaging tooth 9041 of a step 904 is broken, for example, a cracked engaging tooth 9041' shown in FIG. 2, in this case, a foreign matter (such as clothes of a passenger) on the step 904 is easily entrapped into the escalator 900 from an engaging line 9034 corresponding to the engaging tooth 9041', causing a severe accident. Therefore, the engaging state detection system according to the embodiment of the present invention continuously or periodically detects the engaging teeth 9041 of the steps 904, to discover breakage of the engaging teeth 9041 in time.

The engaging state detection system in the embodiment shown in FIG. 5 includes a sensing apparatus 310 and a processing apparatus 200 coupled to the sensing apparatus 310. The escalator 900 includes a passenger conveyor controller 910, a driving part 920 such as a motor, an alarm unit 930, and the like.

The sensing apparatus 310 is specifically a depth sensing sensor. The setting of the depth sensing sensor is completely identical to that of the depth sensing sensor of the embodiment shown in FIG. 1, and is not described again herein.

As shown in FIG. 5 continuously, the sensing apparatus 310 of the depth sensing sensor senses the steps 904 of the escalator 900 and obtains multiple depth maps in real time, wherein each pixel or occupation grid in the depth maps also has corresponding depth texture (reflecting depth information).

If the steps 904 need to be monitored all the time, the multiple sensing apparatuses $\mathbf{310}_1$ to $\mathbf{310}_n$ all need to work at the same time to acquire corresponding depth maps regardless of an operation condition having a passenger or a no-load operation condition having no passengers. If the steps 904 need to be detected in a predetermined time, the multiple sensing apparatuses $\mathbf{310}_1$ to $\mathbf{310}_n$ all need to work at the same time to acquire corresponding depth maps when the escalator 900 stops operation or the escalator 900 operates normally in a no-load state. In the depth maps acquired in this case, there is no passenger or article carried by the passenger correspondingly located on the engaging teeth 9041, the subsequent analysis processing will be more accurate, and thus the broken comb teeth can be detected more accurately. The multiple sensing apparatuses $\mathbf{310}_1$ to $\mathbf{310}_n$ all need to work at the same time to acquire corresponding depth maps, and each depth map is transmitted to and stored in the processing apparatus 200. The above process of the sensing apparatus 310 sensing and acquiring the depth maps may be controlled and implemented by the processing apparatus 200 or the passenger conveyor controller 910. The processing apparatus 200 is further responsible for processing data for each frame, and finally obtaining information indicating whether the engaging teeth 9041 of the escalator 900 are in a normal state, for example, determining whether there is a broken engaging tooth 9041.

As shown in FIG. 5 continuously, the processing apparatus 200 is configured to include a background acquisition module 210 and a foreground detection module 220. In the background acquisition module 210, a background model at least related to the engaging teeth 9041 is acquired by learning 3D depth maps when the escalator 900 is in a no-load (that is, no passenger exists) working condition and the engaging teeth 9041 are in a normal state (that is, there are no broken engaging teeth 9041). The background model may be established in an initialization stage of the engaging state detection system, that is, before the engaging teeth 9041 in a daily operation condition are detected, the engaging state detection system is initialized to obtain the background model. The background model may be established through leaning by using, but not limited to, a Gaussian Mixture Model, a Code Book Model, or Robust Principle Components Analysis (RPCA), or the like. The background model obtained by learning the depth maps acquired by the depth sensing sensor is a typical depth background model.

It should be understood that, the background model may be updated adaptively in the subsequent detection stage of the engaging teeth 9041. When the application scene, sensor type, or setting is changed, a corresponding background model may be acquired through learning once again in the initialization stage.

The foreground detection model 220 is configured to compare a real-time acquired depth map with the background model to obtain a foreground object. Specifically, during comparison, if the depth sensing sensor is used, a data frame acquired in real time is a depth map, and the background model is also formed based on the 3D depth maps. For example, an occupation grid of the depth map may be compared with a corresponding occupation grid of the background model (e.g., a depth difference is calculated), depth information of the occupation grid is retained when the difference is greater than a predetermined value (indicating that the occupation grid is), and thus a foreground object can be obtained. The above comparison processing includes differencing processing of depth values, and therefore, it may also be specifically understood as differential processing or a differential method. The foreground object is a passenger, an article carried by the passenger, and the like in most cases. Definitely, if a step 904 is broken, when a corresponding depth map portion thereof is compared with a corresponding portion of the background model, the obtained foreground object may also include a feature reflecting that the step 904 is broken (if any). In an embodiment, the foreground detection module 220 may apply some filtering technologies to remove noise of the foreground object, for example, the noise is removed by using erosion and dilation image processing technologies, to obtain the foreground object more accurately. It should be noted that, in this text, the filtering may include convolution related to a space, time, or time-space kernel, or the like.

In an embodiment, the processing apparatus 200 further includes a foreground feature extraction module 230. The foreground feature extraction module 230 extracts a corresponding foreground feature from the foreground object. To detect the steps 904 of the escalator 900, the extracted foreground feature includes a shape and texture of the foreground object, and even includes information such as a position, wherein the shape information may be embodied or obtained by extracted edge information. By using the depth maps acquired by the depth sensing sensor as an example, the shape, texture, and position information are embodied by changes in depth values of occupation grids in the foreground object.

It should be noted that, herein, the shape feature (descriptor) may be calculated through a technology such as histogram of oriented gradients (HoG), Zernike moment, Centroid Invariance to boundary point distribution, or Contour Curvature. Other features may be extracted to provide additional information for shape (or morphological) matching or filtering. For example, the other features may include, but are not limited to, Scale Invariant Feature Transform (SIFT), a Speed-Up Robust Feature (SURF) algorithm, Affine Scale Invariant Feature Transform (ASIFT), other SIFT variables, Harris Corner Detector, a Smallest Univalue Segment Assimilating Nucleus (SUSAN) algorithm, Features from Accelerated Segment Test (FAST) corner detection, Phase Correlation, Normalized Cross-Correlation, a Gradient Location Orientation Histogram (GLOH) algorithm, a Binary Robust Independent Elementary Features (BRIEF) algorithm, a Center Surround Extremas (CenSure/STAR) algorithm, an Oriented and Rotated BRIEF (ORB) algorithm, and other features.

Referring to FIG. 5 continuously, further, the processing apparatus 200 further includes an engaging state judgment module 240 for the steps. The engaging state judgment module 240 judges whether the step 904 is in a normal state based on the foreground feature. Specifically, the foreground feature may be compared and judged in the background model, for example, by comparing the shape feature, the texture feature, and the position feature of the foreground object with the shape feature, the texture feature, and the position feature related to the engaging teeth 9041 of the step 904 in the background model, it is judged whether the engaging teeth 9041 of the step 904 are broken. It should be noted that, the feature information related to the shape, texture, and position of the step 904 (including the engaging teeth 9041) in the background model may be accomplished in the background acquisition model 210.

In this embodiment or other embodiments, the shape feature may be compared or classified as a particular shape, wherein one or more of the following technologies are used: clustering, Deep Learning, Convolutional Neural Networks, Recursive Neural Networks, Dictionary Learning, a Bag of visual words, a Support Vector Machine (SVM), Decision Trees, Fuzzy Logic, and so on.

In an embodiment, if the foreground feature is a foreground feature related to a foreground object of a passenger, by comparing the foreground feature with the feature information related to the step 904 in the background model, it can be judged that the foreground feature is not related to the step 904. Moreover, whether the foreground object is located on the step 904 engaged with the comb plate 903 may be judged according to the position feature information thereof. If the judgment result is "yes", the judgment on whether the engaging teeth 9041 are broken based on the currently processed depth map is given up or the judgment result of whether the engaging state corresponding to the currently processed depth map is a normal state is given up. This is because the engaging teeth 9041 of the step 904 are inevitably blocked partially in this case, and therefore, it is difficult to judge whether the engaging teeth 9041 in the blocked portion are broken. Data of a next depth map is processed, till it is judged from the acquired position feature of the foreground object that the passenger or the article carried by the passenger is not located on the step 904 engaged with the comb plate 903, and the judgment result of the depth map is used as a detection result of the step 904. Definitely, it should be appreciated that if the foreground feature is a foreground feature related to the foreground object such as a passenger, the judgment processing based on the current depth map may not be given up, thereby implementing judgment on whether the engaging teeth 9041 of the non-blocked portion are broken.

By using that the engaging teeth 9041 are broken in the data processing of the depth map as an example, the acquired foreground object may include a depth map of at least some of the engaging teeth 9041 of the step 904, and features of the object such as the position, texture, and 3D shape are also extracted based on the depth map of the object, and are further compared with the background model. For example, by comparing features such as the texture and the 3D shape corresponding to the same position, it can be judged that an engaging tooth 9041 is absent at a position in this part of the step 904, thereby directly judging that the engaging tooth 9041 is broken.

In still another alternative embodiment, in a detection situation, the depth map acquired by the sensing apparatus 310 is actually basically identical to the depth map data for calculating the background model (for example, when the detected escalator 900 has no load and the engaging teeth 9041 are not broken). In this way, there is basically no foreground object (for example, only noise information exists) in the foreground detection module 220. In this case, the engaging state judgment module 240 may directly determine that the engaging state of the engaging teeth 9041 is a normal state, that is, no engaging teeth 9041 are broken. Therefore, it is unnecessary to make a judgment based on the foreground feature extracted by the foreground feature extraction module 230. Definitely, the above situation may also be understood as follows: there is basically no foreground object obtained in the foreground detection module 220, the foreground feature extraction module 230 cannot extract the feature related to the engaging teeth 9041, and the engaging state judgment module 240 still obtains, based on feature comparison, the judgment result that the engaging state of the engaging teeth 9041 is the normal state.

Further, the engaging state judgment module 240 may be configured to determine, when a judgment result based on multiple (for example, at least two) consecutive depth maps is that the step 904 is in a same abnormal state (for example, an engaging tooth 9041 is broken), that the engaging teeth 9041 of the step 904 are broken and the engaging state is the abnormal state. In this way, it is advantageous in improving the accuracy of judgment.

When the engaging state judgment module 240 in the processing apparatus 200 according to the above embodiment determines that the detected step 904 is in the abnormal state (for example, the step 904 is broken), a corresponding signal may be sent to the passenger conveyor controller 910 of the escalator 900, to take a corresponding measure. For example, the controller 910 further sends a signal to the driving part 920 to reduce the running speed of the steps. The processing apparatus 200 may further send a signal to the alarm unit 930 mounted above the escalator 900, to remind the passenger to watch out. For example, a message such as "The step 904 is broken. Please be careful when you pass through the entry/exit region" is broadcast. Definitely, the processing apparatus 200 may further send a signal to a monitoring center 940 of a building, or the like, to prompt that on-site processing needs to be performed in time. Measures taken specifically when it is found that the engaging teeth 9041 of the steps 904 of the escalator 900 are broken are not limited.

The engaging state detection system of the embodiment shown in FIG. 5 above may implement real-time automatic detection on the engaging teeth 9041 of the steps 904 of the escalator 900. The detection based on the depth maps are more accurate, and the breakage of the engaging teeth 9041 of the steps 904 can be discovered in time, thus helping prevent occurrence of accidents in time.

Figure 6:
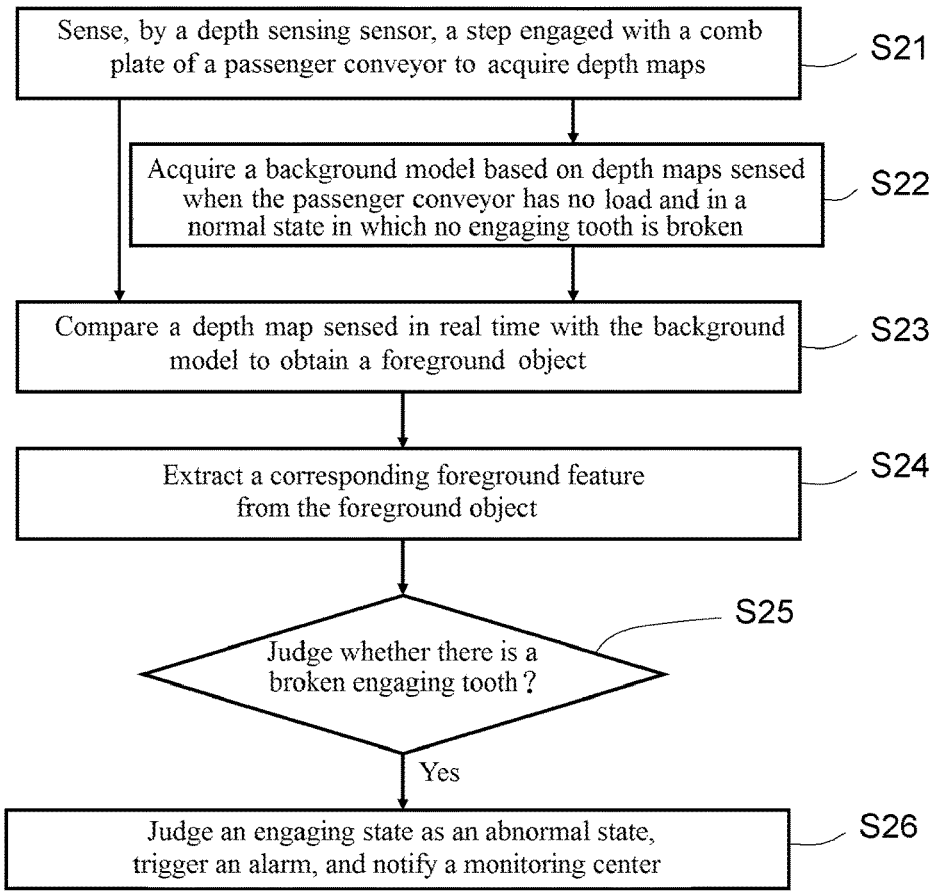
FIG. 6 is a schematic flowchart of an engaging state detection method of steps and comb plates of a passenger conveyor according to the second embodiment of the present invention.

In the following, FIG. 6 exemplifies a process of the method of detecting whether the engaging teeth 9041 of the step 904 are broken by the engaging state detection system in the embodiment shown in FIG. 5. The working principles of the engaging state detection system of the embodiment of the present invention are further illustrated with reference to FIG. 5 and FIG. 6.

First, in step S21, the engaging teeth 9041 of the step 904 of the passenger conveyor are sensed by the depth sensing sensor to acquire depth maps. During acquisition of a background model through learning, the depth maps are acquired through sensing in a no-load state and when the engaging state is a normal state (there is no passenger on the escalator 900 and the engaging teeth 9041 of the step 904 are not broken). In other situations, the depth maps are acquired anytime in a daily operation condition, for example, 30 depth maps may be acquired per second, and depth maps in a time period less than or equal to 1 second are acquired at intervals of a predetermined period of time for subsequent real-time analysis processing.

Further, in step S22, a background model is acquired based on depth maps sensed when the passenger conveyor has no load and in a normal state in which no engaging tooth 9041 is broken. This step is accomplished in the background acquisition module 210, which may be implemented in an initialization stage of the system.

Specifically, when the background model is acquired through learning, feature information such as the shape, position, texture and/or edge may be extracted from multiple depth maps. Grids or regions having features that are basically not changed relatively in the multiple depth maps are accumulated, and grids or regions (of the depth maps) having features that are obviously changed are given up, and therefore, an accurate background model can be obtained through learning. For example, an algorithm adopted by the above accumulation may include, but not limited to, any one or more of the following methods: Principal Component Analysis (PCA), Robust Principal Component Analysis (RPCA), weighted averaging method of non-movement detection, Gaussian Mixture Model (GMM), Code Book Model, and the like.

Further, in step S23, the depth maps sensed in real time are compared with the background model to obtain a foreground object. This step is accomplished in the foreground detection module 220. Moreover, the foreground object may be sent to the engaging state judgment module 240 to be analyzed.

Further, in step S24, a corresponding foreground feature is extracted from the foreground object. This step is accomplished in the foreground feature extraction module 230, and the extracted foreground feature includes, but is not limited to, the shape and texture of the foreground object, and even further includes information such as position. By using the depth maps acquired by the depth sensing sensor as an example, the shape, texture, and position information are embodied by changes in depth values of occupation grids in the foreground object.

Further, in step S25, it is judged whether there is a broken engaging tooth. If the judgment result is "yes", it indicates that the engaging state between the current step 904 and the comb plate 903 is an abnormal state, and the process proceeds to step S26: when the engaging state is judged as the abnormal state, an alarm is triggered and the monitoring center 940 is notified. Step S25 and step S26 are accomplished in the engaging state judgment module 240. Specifically, in step S25, by comparing the shape feature, the texture feature, and the position feature of the foreground object with the shape feature, the texture feature, and the position feature related to the step 904 in the background model, it is judged whether the engaging teeth 9041 of the step 904 are broken. It should be noted that, the feature information related to the shape, texture, and position of the step 904 in the background model are obtained in step S22.

In an embodiment, if the foreground feature is a foreground feature related to the foreground object of a passenger, by comparing the foreground feature with feature information related to the step 904 in the background model, it can be judged that the foreground feature is not related to the step 904. Moreover, whether the foreground object is located on the step 904 may be judged according to the position feature information thereof. If the judgment result is "yes", the judgment on whether the engaging teeth 9041 are broken based on the currently processed depth map is given up or the judgment result of whether the engaging state corresponding to the currently processed depth map is a normal state is given up. This is because the engaging teeth 9041 of the step 904 are inevitably blocked partially in this case, and therefore, it is difficult to judge whether the engaging teeth 9041 in the blocked portion are broken. Data of a next depth map is processed, till it is judged from the acquired position feature of the foreground object that the passenger or the article carried by the passenger is not located on the step 904, and the judgment result of the depth map is used as a detection result of the step 904. Definitely, it should be appreciated that if the foreground feature is a foreground feature related to the foreground object such as a passenger, the judgment processing based on the current depth map may not be given up, thereby implementing judgment on whether the engaging teeth 9041 of the non-blocked portion are broken.

By using that the engaging teeth 9041 are broken in the data processing of the depth map as an example, the acquired foreground object may include a depth map of at least some of the engaging teeth 9041 of the step 904, and features of the object such as the position, texture, and the 3D shape are also extracted based on the depth map of the object, and are further compared with the background model. For example, by comparing features such as the texture and the 3D shape corresponding to the same position, it can be judged that an engaging tooth 9041 is absent at a position in this part of the step 904, thereby directly judging that the engaging tooth 9041 is broken.

In still another alternative embodiment, in a detection situation, the depth maps acquired in step S21 are actually basically identical to the depth map data for calculating the background model (for example, when the detected escalator 900 has no load and the engaging teeth 9041 are not broken). In this case, there is basically no foreground object (for example, only noise information exists) in step S23. In this case, in step S25, it may be directly determined that the engaging state of the engaging teeth 9041 is a normal state, that is, no engaging teeth 9041 are broken. Therefore, it is unnecessary to perform step S24 to make a judgment on the extracted foreground features. Definitely, the above situation may also be understood as follows: there is basically no foreground object obtained in step S23, no features related to the engaging teeth 9041 can be extracted in step S24, and in step S25, the judgment result that the engaging state of the engaging teeth 9041 is the normal state is still obtained based on feature comparison.

In step S25, the process proceeds to step S26 only when the judgment result based on the multiple consecutive depth maps is "yes", and in this way, it helps improve the accuracy of judgment and prevent misoperation.

So far, the detection process of the steps 904 according to the above embodiment basically ends. The process can be repeated and continuously performed. For example, a depth map of each step engaged with the comb plate 903 is sensed continuously in a time period during which the steps 904 run for a circle, such that whether the engaging teeth 9041 of the steps 904 of the escalator 900 are broken can be detected continuously. The detection on all the steps 904 is accomplished, and any broken engaging tooth 9041 of the steps 904 can be discovered.

Figure 7:
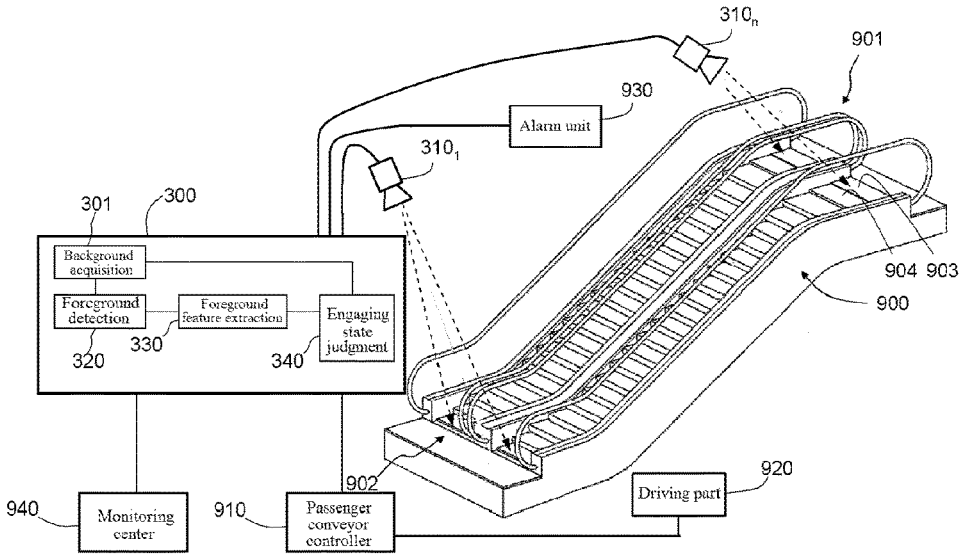
FIG. 7 is a schematic structural diagram of an engaging state detection system of steps and comb plates of a passenger conveyor according to a third embodiment of the present invention.

FIG. 7 shows a schematic structural diagram of an engaging state detection system of steps and comb plates of a passenger conveyor according to a third embodiment of the present invention. The engaging state detection system with reference to the embodiments shown in FIG. 7 and FIG. 2 may be used for detecting whether there is a foreign matter 909 (such as a coin, and clothes of a passenger) on an engaging line 9034 between the comb plate 903 and the step 904 of the escalator 900 of the passenger conveyor in a daily operation condition (including an operation condition having a passenger and a no-load operation condition having no passengers).

Referring to FIG. 7 and FIG. 2, during movement, each step 904 is generally engaged with fixed comb plates 903 in an entry/exit region 901 at a first end and an entry/exit region 902 at a second end of the escalator 900. In a normal state, the engaging teeth 9041 of the steps 904 are not broken, comb teeth 9031 of the comb plates 903 are not broken, and there is no foreign matter 909 on the engaging lines 9034 between the steps 904 and the comb plates 903. Therefore, the engaging teeth 9041 of the steps 904 can be smoothly engaged with the comb teeth 9031 of the comb plates 903, the engaging state is good, and it is highly safe.

However, if there is a foreign matter 909 (for example, the foreign matter 909 on the engaging line 9034 as shown in FIG. 2) on the engaging line 9034 between the comb plate 903 and the step 904, the foreign matter 909 is very easily entrapped between the comb plate 903 and the step 904 during operation of the escalator. When the foreign matter 909 is a hard object, it may directly prevent the comb plate 903 and the step 904 from being engaged, causing a severe safety accident. Therefore, the engaging state detection system according to the embodiment of the present invention continuously or periodically detects the engaging line 9034 between the step 904 and the comb plate 903, to discover a foreign matter 909 on the engaging line 9034 in time.

The engaging state detection system in the embodiment shown in FIG. 7 includes a sensing apparatus 310 and a processing apparatus 300 coupled to the sensing apparatus 310. The escalator 900 includes a passenger conveyor controller 910, a driving part 920 such as a motor, an alarm unit 930, and the like.

The sensing apparatus 310 is specifically a depth sensing sensor. The setting of the depth sensing sensor is completely identical to that of the Depth Sensing Sensor of the embodiment shown in FIG. 1, and is not described again herein.

As shown in FIG. 7 continuously, the sensing apparatus 310 of the depth sensing sensor senses the steps 904 of the escalator 900 and obtain multiple depth maps in real time, wherein each pixel or occupation grid in the depth maps also has corresponding depth texture (reflecting depth information).

If the steps 904 need to be monitored all the time, multiple sensing apparatus $\mathbf{310}_1$ to $\mathbf{310}_n$ all work at the same time to acquire corresponding depth maps regardless of a working condition having a passenger or a no-load operation condition having no passengers. Definitely, the steps 904 may be detected in a predetermined time; however, in an actual application, a foreign matter on the engaging lines 9034 needs to be discovered in time; otherwise, the foreign matter is easily entrapped, thus damaging the escalator 900 and causing an accident. The multiple sensing apparatuses $\mathbf{310}_1$ to $\mathbf{310}_n$ all need to work in real time to acquire corresponding depth maps, and each depth map is transmitted to and stored in the processing apparatus 300. The above process of the sensing apparatus 310 sensing and acquiring the depth maps may be controlled and implemented by the processing apparatus 300 or the passenger conveyor controller 910. The processing apparatus 300 is further responsible for processing data of each frame, and finally obtaining information indicating whether the engaging lines 9034 of the escalator 900 are in a normal state, for example, determining whether there is a foreign matter on the engaging lines 9034.

As shown in FIG. 7 continuously, the processing apparatus 300 is configured to include a background acquisition module 301 and a foreground detection module 320. In the background acquisition module 301, a background model at least related to the engaging teeth 9034 is acquired by learning 3D depth maps when the escalator 900 is in a no-load (that is, no passenger exists) working condition and the engaging line 9034 is in a normal state (that is, there is no foreign matter 909 on the engaging line 9034). The background model may be established in an initialization stage of the engaging state detection system, that is, before the engaging line 9034 in a daily operation condition is detected, the engaging state detection system is initialized to obtain the background model. The background model may be established through leaning by using, but not limited to, a Gaussian Mixture Model, a Code Book Model, or Robust Principle Components Analysis (RPCA), or the like. The background model obtained by learning depth maps acquired by the depth sensing sensor is a typical depth background model.

It should be understood that, the background model may be updated adaptively in the subsequent detection stage of the foreign matter on the engaging line 9034. When the application scene, sensor type, or setting is changed, a corresponding background model may be acquired through learning once again in the initialization stage.

The foreground detection model 320 is configured to compare a real-time acquired depth map with the background model to obtain a foreground object. Specifically, during comparison, if the depth sensing sensor is used, a data frame acquired in real time is a depth map, and the background model is also formed based on the 3D depth maps. For example, an occupation grid of the depth map may be compared with a corresponding occupation grid in the background model (e.g., a depth difference is calculated), depth information of the occupation grid is retained when the difference is greater than a predetermined value (indicating that the occupation grid is), and thus a foreground object can be obtained. The above comparison processing includes differencing processing of depth values, and therefore, it may also be specifically understood as differential processing or a differential method. The foreground object is a passenger, an article carried by the passenger, and the like in most cases. When a corresponding depth map portion thereof is compared with a corresponding portion of the background model, the obtained foreground object may also include a feature reflecting that there is a foreign matter (if any) on the engaging line 9034. In an embodiment, the foreground detection module 320 may apply some filtering technologies to remove noise of the foreground object, for example, the noise is removed by using erosion and dilation image processing technologies, to obtain the foreground object more accurately. It should be noted that, the filtering may include convolution related to a space, time, or time-space kernel, or the like.

In an embodiment, the processing apparatus 300 further includes a foreground feature extraction module 330. The foreground feature extraction module 330 extracts a corresponding foreground feature from the foreground object. To detect a foreign matter on the engaging line 9034 of the escalator 900, the extracted foreground feature includes a shape and texture of the foreground object, and even includes information such as a position, wherein the shape information may be embodied or obtained by extracted edge information. By using the depth maps acquired by the depth sensing sensor as an example, the shape, texture, and position information are embodied by changes in depth values of occupation grids in the foreground object.

Referring to FIG. 7 continuously, further, the processing apparatus 300 further includes an engaging state judgment module 340. The engaging state judgment module 340 judges whether the step 904 is in a normal state based on the foreground feature. Specifically, the foreground feature may be compared and judged in the background model, for example, by comparing the shape feature, the texture feature, and the position feature of the foreground object with the shape feature, the texture feature, and the position feature related to the engaging line 9034 of the step 904 in the background model, it is judged whether a foreign matter is located on the engaging line 9034, and the size, shape, and the like of the foreign matter are judged. It should be noted that, the feature information related to the shape, texture, and position of the step 904 (including the engaging line 9034) in the background model may be accomplished in the background acquisition model 301. It should be further noted that, if the engaging state judgment module 340 has the functions of both the engaging state judgment module 140 and the engaging state judgment module 240, according to the shape feature, the texture feature, and the position feature of the engaging teeth 9041 or the comb teeth 9031, it may be judged whether the foreground object corresponding to the engaging line 9034 is a foreign matter or a broken engaging tooth 9041' or comb tooth 9031'.

By using that there is a foreign matter 909 on the engaging line 9034 in the data processing of the depth maps as an example, the acquired foreground object may include a depth map of the foreign matter 909, and features of the object such as the position, texture, and 3D shape are also extracted based on the depth map of the object, and are further compared with the background model. For example, by comparing features such as the texture and the 3D shape corresponding to the same position, it may be judged that there is a foreign matter 909 in the foreground and the foreign matter 909 is located on the engaging line 9034, thereby directly judging that there is a foreign matter on the engaging line 9034.

In still another alternative embodiment, in a detection situation, the depth map acquired by the sensing apparatus 310 is actually basically identical to the depth map data for calculating the background model (for example, when the detected escalator 900 has no load and there is no foreign matter on the engaging lines 9034). In this way, there is basically no foreground object (for example, only noise information exists) in the foreground detection module 320. In this case, the engaging state judgment module 340 may directly determine that the engaging state of the engaging line 9034 is a normal state, that is, no foreign matter exists on the engaging line 9034. Therefore, it is unnecessary to make a judgment based on the foreground feature extracted by the foreground feature extraction module 330. Definitely, the above situation may also be understood as follows: there is basically no foreground object obtained in the foreground detection module 320, the foreground feature extraction module 330 cannot extract the feature related to the foreign matter, and the engaging state judgment module 340 still obtains, based on feature comparison, the judgment result that there is no foreign matter, that is, obtains the judgment result that the engaging state of the engaging line 9034 is the normal state.

Further, the engaging state judgment module 340 may be configured to determine that there is a foreign matter on the engaging line 9034 between the step 904 and the comb plate 903 and the engaging state is the abnormal state only when the judgment result based on depth maps consecutively sensed in a predetermined time period (e.g., 2 s to 5 s) is that the step 904 is in the same abnormal state (for example, a foreign matter is constantly located on the engaging line 9034). In this way, it is advantageous in improving the accuracy of judgment. During real-time detection, a passenger usually does not stamp on the engaging line 9034, but in the depth map acquired when the passenger or an article carried by the passenger passes through the engaging line 9034, there is an object on the engaging line 9034. The foreground object acquired from the foreground detection module 320 also includes a foreground object portion located on the engaging line 9034. Therefore, the engaging state judgment module 340 may easily judge that there is a foreign matter on the engaging line 9034, thus causing misjudgment.

In still another alternative embodiment, the engaging state judgment module 340 may detect, by using an optical flow method technology, the speed of the foreign matter on the engaging line 9034 between the step 904 and the comb plate 903. When the speed of the foreign matter on the engaging line 9034 is obviously lower than the speed of the steps of the escalator 900 (for example, one third of the speed of the steps of the escalator or even lower), or obviously slower than the speed of another foreground object in an adjacent region, the engaging state judgment module 340 may determine that the foreign matter has been or is going to be entrapped. The engaging state judgment module 340 may also determine that the foreign matter has been or is going to be entrapped only when a relatively low speed state of the foreign matter maintains for a predetermined period of time (e.g., 1 s).

In the above embodiment, to detect the speed of the foreign matter, the engaging state judgment module 340 may be provided with an optical flow estimation submodule, a calibration submodule, a time calculation submodule, and a speed calculation submodule. The optical flow estimation submodule, the calibration submodule, the time calculation submodule, and the speed calculation submodule may analyze the foreground object about the foreign matter or another object acquired by the foreground detection module 120, to obtain speed information thereof.

Specifically, the optical flow estimation submodule is first configured to calculate a feature point in the depth map by using, for example, Moravec Corner Detection, Harris Corner Detection, Förstner Corner Detection, Laplacian of Gaussian Interest Points, Differences of Gaussians Interest Points, Hessian Scale-space Interest Points, Wang and Brady Corner detection, SUSAN Corner Detection, Trajkovic-Hedley Corner Detection, or the like. The feature point may be found through, for example, SIFT, SURF, ORB, FAST, BRIEF and other local feature descriptors. In addition, the feature point may be matched with one depth map to a next depth map based on a large region pattern by using, for example, a sum of absolute differences, a convolution technique, or a probabilistic technique.

In addition, the optical flow estimation submodule further calculates, based on an optical flow method, a shift, in depth map coordinates, of a corresponding feature point between any adjacent depth maps in the depth map sequence. The optical flow method may be specifically a Lucas-Kanade optical flow method. The type of the optical flow method specifically applied herein is not limited. The system and the method disclosed herein can also be applied to any two depth maps of the depth map sequence, wherein corresponding feature points of the two depth maps can be found. The phrase "adjacent depth maps" should be understood as two depth maps for calculating an optical flow between depth maps.

The calibration submodule of the engaging state judgment module 340 further converts the shift of the feature point in the depth map coordinates to a shift in three-dimensional space coordinates, wherein the three-dimensional space coordinates may be established, for example, based on an imaging sensor, and the standard of the establishment thereof is not limited. The calibration process may be offline accomplished in advance before the speed detection. For example, calibration is performed again after mounting of the imaging sensor and/or the depth sensing sensor is completed or after the key setting thereof changes. The specific method for calibration is not limited.

The time calculation submodule of the engaging state judgment module 340 further determines a time quantity between any adjacent depth maps in the depth map sequence. By taking that 30 depth maps are acquired per second as an example, the time quantity between adjacent depth maps is substantially 1/30 s. Specifically, each depth map is marked with a time stamp when acquired, and thus the time quantity between any depth maps can be acquired. It should be understood that "adjacent depth maps" may be consecutively acquired depth maps.

The speed calculation sub-module of the engaging state judgment module 340 further obtains by calculation, based on the shift of the feature point in the three-dimensional space coordinates and the corresponding time quantity, speed information of time points corresponding to any adjacent depth maps, and further combines the speed information to obtain speed information of the depth map sequence. By taking that there are n depth map sequences acquired per second as an example, (n−1) pieces of speed information may be obtained per second, and the (n−1) pieces of speed information are combined together to obtain speed information of the n depth map sequences. It should be noted that the speed information may include speed magnitude information and speed direction information. The engaging state judgment module 340 may judge, based on the speed magnitude information, whether the speed of the foreign matter on the engaging line 9034 is obviously lower than the speed of the steps of the escalator 900 or obviously slower than the speed of another foreground object in an adjacent region.

When the engaging state judgment module 340 in the processing apparatus 300 of the above embodiment determines that the detected comb line 9034 is in the abnormal state (for example, there is a foreign matter on the step 9034), a corresponding signal may be sent to the passenger conveyor controller 910 of the escalator 900, to take a corresponding measure. For example, the controller 910 further sends a signal to a braking part to brake slowly. The processing apparatus 300 may further send a signal to the alarm unit 930 mounted above the escalator 900, to remind the passenger to watch out. For example, a message such as "Be careful not to get a foreign matter entrapped. Please be careful when you pass through the entry/exit region" is broadcast. Definitely, the processing apparatus 300 may further send the signal to the monitoring center 940 of a building, or the like, to prompt that it needs to be confirmed on site whether there is a foreign matter entrapped so that possible foreign matter on or entrapped into the engaging line 9034 is removed in time. Measures taken specifically when it is found there is a foreign matter on the engaging line 9034 of the escalator 900 are not limited.

The engaging state detection system of the embodiment shown in FIG. 7 above may implement real-time automatic detection on the engaging lines 9034 of the escalator 900. The detection based on the depth maps are more accurate, and the foreign matter on the engaging lines 9034 can be discovered in time, thus helping timely remove the foreign matter to avoid entrapping, and preventing occurrence of accidents.

Figure 8:
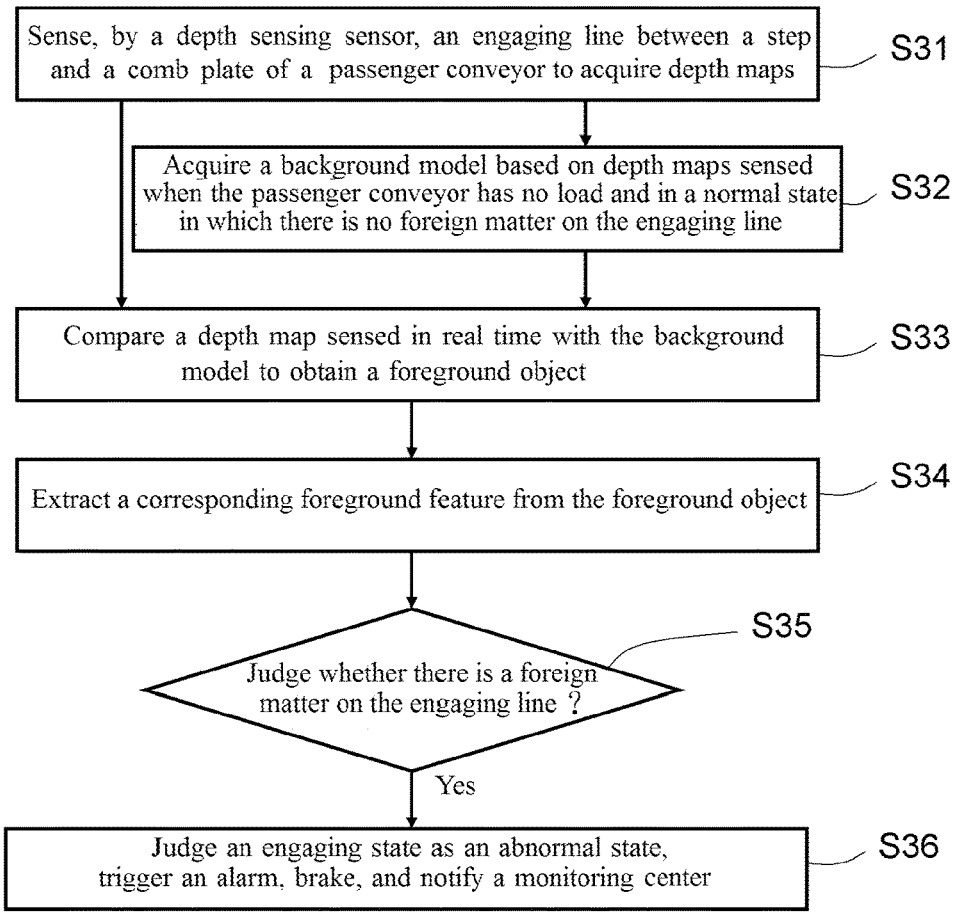
FIG. 8 is a schematic flowchart of an engaging state detection method of steps and comb plates of a passenger conveyor according to the third embodiment of the present invention.

In the following, FIG. 8 exemplifies a process of the method of detecting whether there is a foreign matter on the engaging line 9034 between the step 904 and the comb plate 903 by the engaging state detection system in the embodiment shown in FIG. 7. The working principles of the engaging state detection system of the embodiment of the present invention are further illustrated with reference to FIG. 7 and FIG. 8.

First, in step S31, the engaging teeth 9034 between the step 904 and the comb plate 903 of the passenger conveyor are sensed by a depth sensing sensor to acquire depth maps. During acquisition of a background model through learning, the depth maps are acquired through sensing in a no-load state and when the engaging state being in a normal state (there is no passenger on the escalator 900 and there is no foreign matter 909 on the engaging line 9034 of the step 904). In other situations, the depth maps are acquired anytime in a daily operation condition, for example, 30 depth maps may be acquired per second, and depth maps are acquired consecutively for the subsequent real-time analysis processing.

Further, in step S32, a background model is acquired based on depth maps sensed when the passenger conveyor has no load and in a normal state in which there is no foreign matter on the engaging line 9034. This step is accomplished in the background acquisition module 301, which may be implemented in an initialization stage of the system.

Specifically, when the background model is acquired through learning, feature information such as the shape, position, texture and/or edge may be extracted from multiple depth maps. Grids or regions having features that are basically not changed relatively in the multiple depth maps are accumulated, and grids or regions (of the depth maps) having features that are obviously changed are given up, and therefore, an accurate background model can be obtained through learning. For example, an algorithm adopted by the above accumulation may include, but not limited to, any one or more of the following methods: Principal Component Analysis (PCA), Robust Principal Component Analysis (RPCA), weighted averaging method of non-movement detection, Gaussian Mixture Model (GMM), Code Book Model, and the like.

Further, in step S33, a depth map sensed in real time is compared with the background model to obtain a foreground object. This step is accomplished in the foreground detection module 320. Moreover, the foreground object may be sent to the engaging state judgment module 340 to be analyzed.

Further, in step S34, a corresponding foreground feature are extracted from the foreground object. This step is accomplished in the foreground feature extraction module 330, and the extracted foreground feature includes, but is not limited to, the shape and texture of the foreground object, and even further includes information such as position. By using the depth maps acquired by the depth sensing sensor as an example, the shape, texture, and position information are embodied by changes in depth values of occupation grids in the foreground object.

Further, in step S35, it is judged whether there is a foreign matter on the engaging line 9034. If the judgment result is "yes", it indicates that the engaging state between the current step 904 and the comb plate 903 is an abnormal state, and the process proceeds to steps S36: when the engaging state is judged as the abnormal state, an alarm is triggered, the escalator is braked, and the monitoring center 940 is notified. Step S35 and step S36 are accomplished in the engaging state judgment module 340.

Specifically, in step S35, the shape feature, the texture feature, and the position feature of the foreground object are compared with the shape feature, the texture feature, and the position feature related to the engaging line 9034 in the background model, to judge whether there is a foreground object on the engaging line 9034 of the step 904. If no, it is further judged, based on the position feature, whether the foreground object is located on the engaging line 9034. It should be noted that, the feature information related to the shape, texture, and position of the step 904 in the background model are obtained in step S32.

By using that there is a foreign matter 909 on the engaging line 9034 in the data processing of the depth map as an example, the acquired foreground object may include a depth map of the foreign matter 909, and features of the object such as the position, texture, and 3D shape are also extracted based on the depth map of the object, and are further compared with the background model. For example, by comparing features such as the texture and the 3D shape corresponding to the same position, it may be judged that there is a foreign matter 909 in the foreground and foreign matter 909 is located on the engaging line 9034, thereby directly judging that there is a foreign matter on the engaging line 9034.

In still another alternative embodiment, in a detection situation, the depth maps acquired in step S31 are actually basically identical to the depth map data for calculating the background model (for example, when the detected escalator 900 has no load and there is no foreign matter on the engaging line 9034). In this way, there is basically no foreground object (for example, only noise information exists) in step S32. In this case, in step S35, it may be directly determined that there is no foreign matter on the engaging line 9034. Therefore, it is unnecessary to make a judgment based on the extracted foreground features extracted through step S33. Definitely, the above situation may also be understood as follows: there is basically no foreground object obtained in step S32, no features related to the foreign matter can be extracted in step S33, and in step S35, the judgment result that there is no foreign matter is still obtained based on feature comparison, that is, the judgment result that the engaging state of the engaging line 9034 is the normal state.

In step S35, the process proceeds to step S36 only when the judgment result based on the depth maps consecutively sensed in a predetermined time period (e.g., 2 s to 5 s) is "yes", and in this way, it helps improve the accuracy of judgment and prevent misoperation.

Specifically, suppose that the foreground feature is a foreground feature of a foreground object of an undetermined object (it may be a passenger or an article carried by the passenger), by comparing the foreground feature with the feature information related to the engaging line 9034 in the background model, it can be judged that the foreground feature is not related to the comb teeth 9031 and the engaging teeth 9041 on the engaging line 9034. Moreover, it can be judged whether the foreground object is located on the engaging line 903 according to the position feature information thereof. If the judgment result is "no", it is directly judged whether an engaging state corresponding to the currently processed depth map is a normal state; if the judgment result is "yes", a judgment result of depth maps in a subsequent time period of, for example, 2 s to 5 s is waited for. If the judgment result is also "yes", it indicates that the foreign matter is constantly located on the engaging line 9034, and the case that the passenger or the article carried by the passenger passes through the engaging line 9034 is excluded. At this time, the process proceeds to step S36. In another alternative embodiment, the speed of the foreign matter on the engaging line 9034 is further judged. Step S36 is performed based on judgment on a constant (e.g., 1 s) or instant low speed of the object on the engaging line 9034. The can help improve the accuracy of judgment and prevent misjudgment.

So far, the process of detecting the steps 904 of the above embodiment basically ends, and the process may be repeated and continuously performed, to continuously monitor the engaging lines 9034, and discover a foreign matter on the engaging lines 9034 in time, thus effectively preventing the foreign matter from being entrapped into the engaging lines 9034.

It should be noted that the processing apparatus (100 or 200 or 300 in the engaging state detection system in the embodiments shown in FIG. 1, FIG. 5 and FIG. 7) may be arranged separately, or may be specifically arranged in the monitoring center 940 of the building, or may be integrated with the controller 910 of the escalator 900. The specific setting manner thereof is not limited. Moreover, at least two of the engaging state detection systems in the embodiments shown in FIG. 1, FIG. 5 and FIG. 7 can be integrated for implementation, and share the sensing apparatus 310, thus implementing detection on at least two of the comb teeth 9031 of the comb plates 903, the engaging teeth 9041 of the steps 904, and the foreign matter on the engaging lines 9034, and indicating that the engaging state is an abnormal state when any one of them is judged to be in an abnormal state. Therefore, simultaneous detection of multiple engaging sates may be implemented, thus helping reduce the cost.

It should be noted that the elements disclosed and depicted herein (including flowcharts and block diagrams in the accompanying drawings) imply logical boundaries between the elements. However, according to software or hardware engineering practices, the depicted elements and the functions thereof may be executed on machines through a computer executable medium. The computer executable medium has a processor capable of executing program instructions stored thereon as monolithic software structures, as standalone software modules, or as modules that employ external routines, code, services, and so forth, or any combination thereof, and all such implementations may fall within the scope of the present disclosure.

Although the different non-limiting implementation solutions have specifically illustrated components, the implementation solutions of the present invention are not limited to those particular combinations. It is possible to use some of the components or features from any of the non-limiting implementation solutions in combination with features or components from any of the other non-limiting implementation solutions.

Although particular step sequences are shown, disclosed, and claimed, it should be appreciated that the steps may be performed in any order, separated or combined, unless otherwise indicated and will still benefit from the present disclosure.

The foregoing description is exemplary rather than defined by the limitations within. Various non-limiting implementation solutions are disclosed herein, however, persons of ordinary skill in the art would recognize that various modifications and variations in light of the above teachings will fall within the scope of the appended claims. It is therefore to be appreciated that within the scope of the appended claims, the disclosure may be practiced other than as specifically disclosed. For that reason, the appended claims should be studied to determine the true scope and content.

What is claimed is:

1. An engaging state detection system of steps and comb plates of a passenger conveyor, comprising:

a depth sensing sensor configured to sense at least an engaging portion between a step and a comb plate of the passenger conveyor to obtain depth maps; and a processing apparatus configured to analyze the depth maps to detect whether the engaging state between the step and the comb plate is a normal state, the processing apparatus being configured to comprise:

a background acquisition module configured to acquire a background model based on depth maps sensed when the passenger conveyor has no load and the engaging state is a normal state;

a foreground detection module configured to compare a depth map sensed in real time with the background acquisition model to obtain a foreground object; and an engaging state judgment module configured to process data at least based on the foreground object to judge whether the engaging state is a normal state.

2. The engaging state detection system of claim 1, wherein the processing apparatus further comprises:

a foreground feature extraction module configured to extract a corresponding foreground feature from the foreground object according to the engaging state;

wherein the engaging state judgment module judges whether the engaging state is a normal state based on the foreground feature.

3. The engaging state detection system of claim 2, wherein sensing of the engaging portion between the step and the comb plate comprises sensing of comb teeth of the comb plate, and the engaging state judgment module is configured to judge the engaging state as an abnormal state when at least one of the comb teeth is broken.

4. The engaging state detection system of claim 3, wherein the foreground feature extracted by the foreground feature extraction module comprises one or more of a shape feature, a texture feature, and a position feature of the foreground object, and the engaging state judgment module judges whether the comb teeth are broken based on one or more of the shape feature, the texture feature, and the position feature of the foreground object.

5. The engaging state detection system of claim 3, wherein the engaging state judgment module is further configured to judge, based on the position feature of the foreground object, whether a foreground object corresponding to a passenger or an article carried by the passenger is located on the comb teeth, and if the judgment result is "yes", give up the judgment on whether the comb teeth are broken based on the currently processed depth map or give up the judgment result of whether the engaging state corresponding to the currently processed depth map is a normal state.

6. The engaging state detection system of claim 2, wherein sensing of the engaging portion between the step and the comb plate comprises sensing of engaging teeth of the step, and the engaging state judgment module judges the engaging state as an abnormal state when at least one of the engaging teeth is broken.

7. The engaging state detection system of claim 6, wherein the foreground feature extracted by the foreground feature extraction module comprises one or more of a shape feature, a texture feature, and a position feature of the foreground object, and the engaging state judgment module judges whether the engaging teeth are broken based on one or more of the shape feature, the texture feature, and the position feature of the foreground object.

8. The engaging state detection system of claim 6, wherein the engaging state judgment module is further configured to judge, based on the position feature of the foreground object, whether a foreground object corresponding to a passenger or an article carried by the passenger is located on the step, and if the judgment is result "yes", give up the judgment on whether the engaging teeth are broken based on the currently processed depth map or give up the judgment result of whether the engaging state corresponding to the currently processed depth map is a normal state.

9. The engaging state detection system of claim 2, wherein sensing of the engaging portion between the step and the comb plate comprises sensing of a foreign matter on an engaging line between the comb plate and the step, and the engaging state judgment module is configured to judge the engaging state as an abnormal state when there is a foreign matter on the engaging line.

10. The engaging state detection system of claim 9, wherein the foreground feature extracted by the foreground feature extraction module comprises one or more of a shape feature, a texture feature, and a position feature of the foreground object, and the engaging state judgment module is further configured to judge, based on one or more of the shape feature, the texture feature, and the position feature of the foreground object, whether the foreground object is a foreground object corresponding to the broken engaging teeth or comb teeth, and if the judgment result is "no", further judge, based on the position feature, whether the foreign matter is located on the engaging line.

11. The engaging state detection system of claim 9, wherein the engaging state judgment module is further configured to determine that the engaging state is the abnormal state when the judgment result based on the depth maps sensed consecutively in a predetermined time period is that there is a foreign matter on the engaging line and the speed of the foreign matter is lower than the speed of the step or lower than the speed of another foreground object in an adjacent region of the foreign matter.

12. The engaging state detection system of claim 1, wherein there are two depth sensing sensors, which are respectively disposed approximately above entry/exit regions at two ends of the passenger conveyor to separately sense the comb plates and the steps engaged with the comb plates in the entry/exit regions.

13. The engaging state detection system of claim 3, wherein in the background acquisition module, the background model is acquired based on the depth maps sensed when the engaging state is the normal state; and the engaging state judgment module is further configured to directly determine that the engaging state is the normal state when there is basically no foreground object.

14. The engaging state detection system of claim 3, wherein in the background acquisition module, the background module is established through learning by using one or more of a Gaussian Mixture Model, a Code Book Model, and Robust Principle Components Analysis (RPCA).

15. The engaging state detection system of claim 3, wherein the foreground detection module is further configured to remove noise of the foreground object by using erosion and dilation image processing technologies.

16. The engaging state detection system of claim 1, wherein a sensing apparatus of the depth sensing sensor is mounted on a handrail side plate facing the engaging line between the comb plate and the step.

17. An engaging state detection method of steps and comb plates of a passenger conveyor, comprising steps of:

sensing, by a depth sensing sensor, at least an engaging portion between a step and a comb plate of the passenger conveyor to obtain depth maps;

acquiring a background model based on depth maps sensed when the passenger conveyor has no load and the engaging state is a normal state;

comparing a depth map sensed in real time with the background model to obtain a foreground object; and processing data at least based on the foreground object to judge whether the engaging state is a normal state.

18. The engaging state detection method of claim 17, further comprising a step of: extracting a corresponding foreground feature from the foreground object according to the engaging state;

wherein in the step of judging the engaging state, whether the engaging state is a normal state is judged based on the foreground feature.

19. The engaging state detection method of claim 18, wherein sensing of the engaging portion between the step and the comb plate comprises sensing of comb teeth of the comb plate, and in the step of judging the engaging state, the engaging state is judged as an abnormal state when at least one of the comb teeth is broken.

20. The engaging state detection method of claim 18, wherein sensing of the engaging portion between the step and the comb plate comprises sensing of engaging teeth of the step, and in the step of judging the engaging state, the engaging state is judged as an abnormal state when at least one of the engaging teeth is broken.

21. The engaging state detection method of claim 18, wherein sensing of the engaging portion between the step and the comb plate comprises sensing of a foreign matter on an engaging line between the comb plate and the step, and in the step of judging the engaging state, the engaging state is judged as an abnormal state at least when there is a foreign matter on the engaging line.

22. The engaging state detection method of claim 21, wherein in the step of extracting the foreground feature, the extracted foreground feature comprises one or more of a shape feature, a texture feature, and a position feature of the foreground object; and in the step of judging the engaging state, whether the foreground object is a foreground object corresponding to the broken engaging teeth or comb teeth is judged based on one or more of the shape feature, the texture feature, and the position feature of the foreground object, and if the judgment result is "no", it is further judged, based on the position feature, whether the foreign matter is located on the engaging line.

23. The engaging state detection method of claim 21, wherein in the step of judging the engaging state, it is determined that the engaging state is the abnormal state when a judgment result based on the depth maps sensed consecutively in a predetermined time period is that there is a foreign matter on the engaging line and the speed of the foreign matter is lower than the speed of the step or lower than the speed of another foreground object in an adjacent region of the foreign matter.

24. The engaging state detection method of claim 19, wherein in the model acquisition step, the background model is acquired based on the depth maps sensed when the engaging state is the normal state; and in the step of judging the engaging state, it is directly determined that the engaging state is the normal state when there is basically no foreground object.

25. The engaging state detection method of claim 17, further comprising a step of: triggering an alarm when it is determined that the engaging state is the abnormal state.

26. The engaging state detection method of claim 17, wherein outputting of a signal is triggered to the passenger conveyor and/or a monitoring center when it is determined that the engaging state is the abnormal state.

27. A passenger conveying system, comprising a passenger conveyor and the engaging state detection system according to claim 1.

* * * * *